United States Patent [19]

Leumi

[11] Patent Number: 5,067,626

[45] Date of Patent: Nov. 26, 1991

[54] TRASH RECEPTACLE ADAPTED FOR ROTATABLE MOUNTING HAVING INTEGRAL LOCKING AND SUPPORTING MEANS

[76] Inventor: Dov A. Leumi, 300 E. Lancaster Ave., Wynwood Apts. #708, Wynwood, Pa. 19160

[21] Appl. No.: 553,121

[22] Filed: Jul. 13, 1990

[51] Int. Cl.[5] ..... B65F 1/12

[52] U.S. Cl. ..... 220/475; 220/478; 220/908; 248/146; 248/907

[58] Field of Search ..... 248/907, 130, 137, 142, 248/291; 220/908, 475, 478

[56] References Cited

U.S. PATENT DOCUMENTS

| | | | |
|---|---|---|---|
| 1,422,064 | 7/1922 | Kane | 220/478 |
| 2,086,355 | 7/1937 | Eansor | 248/291 |
| 2,303,067 | 9/1939 | Richard | 248/907 |
| 2,735,134 | 2/1956 | Green et al. | 16/331 |
| 2,903,219 | 9/1959 | Ingham | 248/137 |
| 2,952,434 | 9/1960 | Blanchard | 248/137 |
| 3,235,212 | 2/1966 | Baumiller | 220/475 |
| 3,240,459 | 3/1966 | Spohn | 248/907 |
| 3,317,225 | 5/1967 | Cooper | 248/291 |
| 3,845,928 | 11/1974 | Barrett et al. | 248/291 |
| 4,860,909 | 8/1989 | Leumi | 248/907 |

FOREIGN PATENT DOCUMENTS

| | | | |
|---|---|---|---|
| 663275 | 3/1954 | Canada | 248/907 |

*Primary Examiner*—Stephen Marcus
*Assistant Examiner*—S. Castellano

[57] ABSTRACT

A trash basket with a support which is designed to lock the basket in a normal upright position for receiving and holding trash, and to be unlocked so as to permit rotation for emptying.

4 Claims, 5 Drawing Sheets

TRASH RECEPTACLE ADAPTED FOR ROTATABLE MOUNTING HAVING INTEGRAL LOCKING AND SUPPORTING MEANS

BACKGROUND OF THE INVENTION

1. Field of the Invention

This invention relates generally to a trash receptacle which is adapted to be rotatably mounted upon a structure.

2. Description of the Prior Art

My U.S. Pat. No. 4,860,909 of Aug. 29, 1989 described a trash receptacle mounted for rotation wherein the basket was fixable in an upright position by a latching member comprising a rod slidably connected to the basket with openings in the supporting member aligned with the slidable member. One disadvantage of the slidable latch system was that it was subject to vandalism because it was readily apparent how the baskets could be unlatched for rotation to empty the trash. A second disadvantage was in the appearance of the visible slidable member.

SUMMARY OF THE INVENTION

It is an object of the present invention to provide an improved trash receptacle which can be rotated for emptying but can be locked against rotation without use of a slidable rod and openings in the supporting member.

It is a further object of the invention to provide a trash receptacle which is adapted to be rotatably mounted upon a supporting structure and which has a better appearance than the prior apparatus.

A further object is to provide a trash receptacle which has concealed locking means which is easily and quickly unlocked by authorized persons.

A still further object is to provide a rotatable trash receptacle which has concealed locking means which is unlockable for rotation by use of force and has means of adjustment regarding the degree of force necessary.

These objects and others which will become apparent from the following disclosure are achieved by the present invention which comprises in one aspect an apparatus useful for collecting and removal of trash comprising at least one basket, integral supporting and locking means for connecting said basket to a supporting structure, said means adapted to (A) support said basket, (B) lock said basket in a normal upright position for receiving and holding trash, (C) be unlocked so as to permit rotation of said basket for emptying said trash.

BRIEF DESCRIPTION OF THE DRAWINGS

The drawings illustrate but a few of several possible embodiments of the invention.

Other objects and many of the attendant advantages of this invention will be readily appreciated as the same becomes better understood by reference to the following detailed description when considered in connection with the accompanying drawings wherein.

DETAILED DESCRIPTION OF THE INVENTION AND THE PREFERRED EMBODIMENTS

Figure 1:
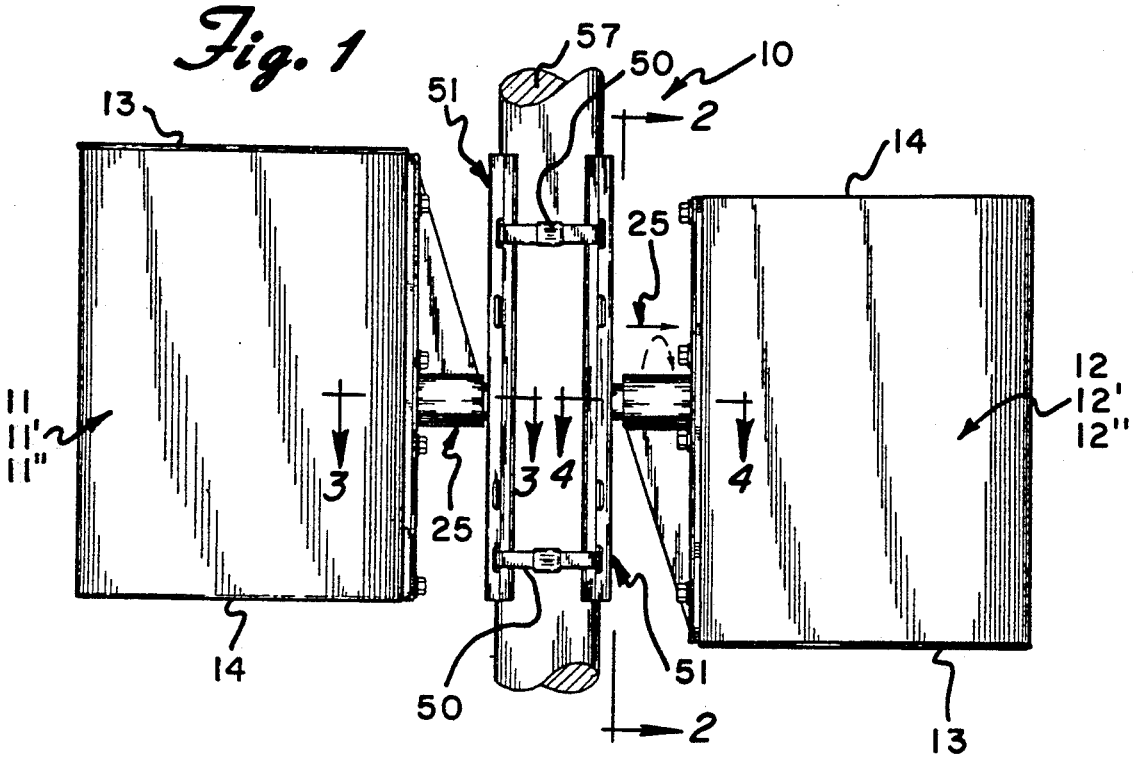
FIG. 1 is a side elevational view of a pair of an apparatus for collecting and removal of trash according to the invention.
Figure 2:
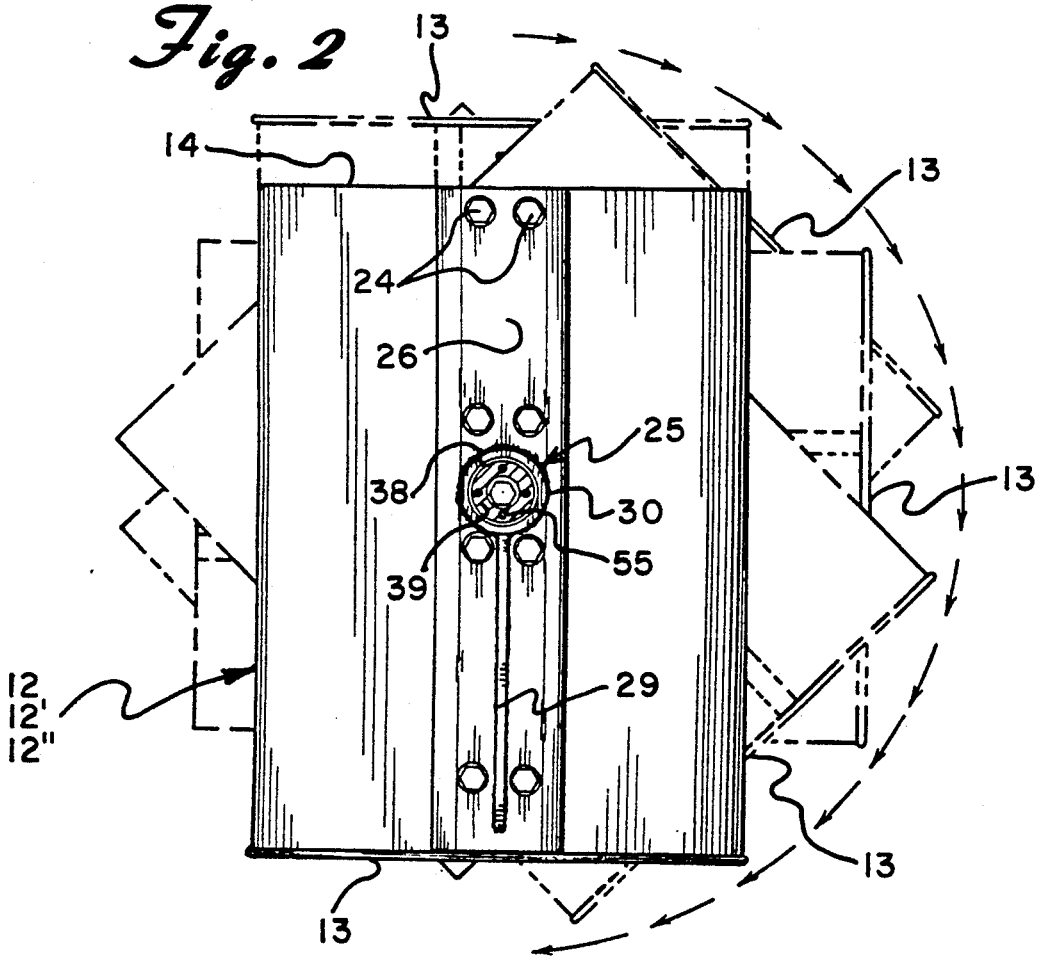
FIG. 2 is a combination sectional and plan view taken along the line 2—2 in FIG. 1.
Figure 12:
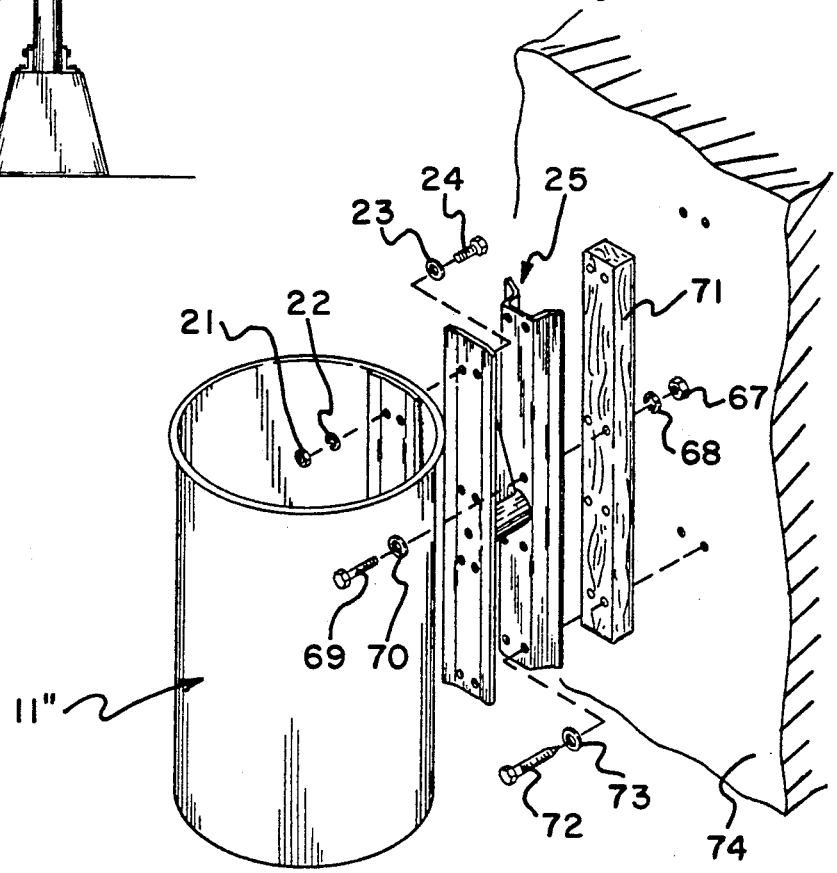
FIG. 12 is an expanded plan view of an embodiment of the invention wherein the trash receptacle 11 is supported on a wall 74.

Referring now in greater detail to the various figures of the drawings wherein like reference numerals refer to like parts, an apparatus for collecting and removal of trash comprising at least one basket 11 and 12 or 11' and 12', or 11'' or 12'' (hereinafter referred to as 11 for convenience) representing three alternative size baskets in FIG. 1, are supported by integral supporting and locking means 25 for connecting said basket to a supporting structure 57, said means 25 adapted to (A) support said basket 11 (B) lock said basket 11 in a normal upright position for receiving and holding trash, (C) be unlocked, so as to permit rotation of said basket for emptying said trash. Referring to FIG. 1, basket 11 has an opening 13 for receiving trash and a bottom 14. Basket 11 can be mesh, solid metal or rigid plastic, of round, square, or other cross section, or the like. The apparatus of the invention is connected to a supporting structure 57 such as a telephone pole, a light standard, a special pole erected to primarily to support the trash apparatus of the invention, a wall 74 as in FIG. 12, and the like, but the pole or wall structure itself is not part of the invention. Pole mounting bracket 51 can be held on to the pole 57 with metal bands 50. The baskets 11 can be rotated as shown in FIG. 2 for emptying by pulling a basket 11 in a direction away from pole supporting structure 57 which operates to unlock integral supporting and locking means 25. The force needed to pull said basket 11 is dependent on the tension exerted by adjusting spring 43 (or any other means of imparting tension to maintain locking means 25 in a normally locked position) which exerts a force in the opposite direction. In the illustrated embodiment, the basket must be pulled a sufficient distance so that key 40 can clear reciprocal keyway 36 and rotating interlocking keyed cylinder 35 is free to rotate.

FIG. 1 shows basket 11 in a locked and normal position for receiving trash and shows basket 12 in a pulled out, unlocked position with the open end of the, basket facing down for emptying.

Figure 3:
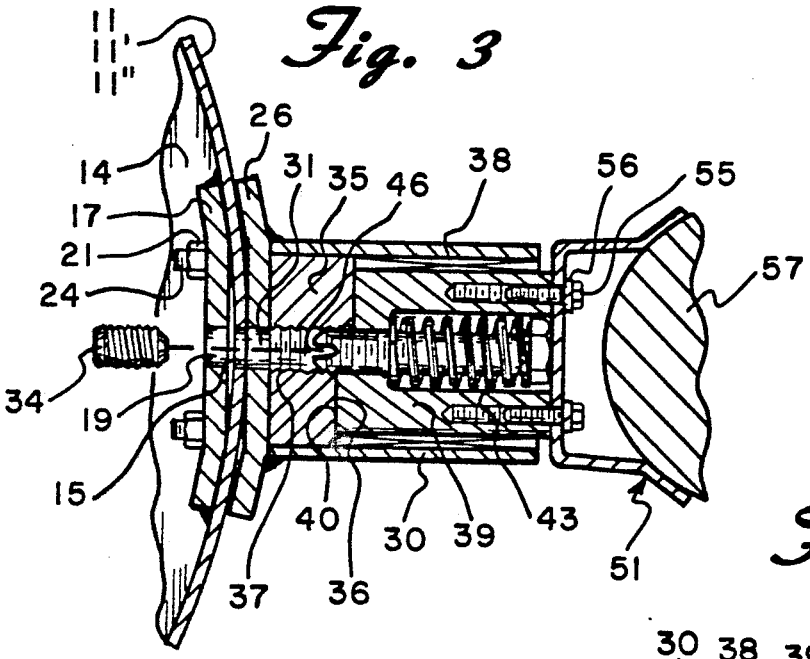
FIG. 3 is an enlarged sectional view taken along the line 3—3 in FIG. 1, expanded to show removal of adjustment slot protector screw 34.
Figure 5:
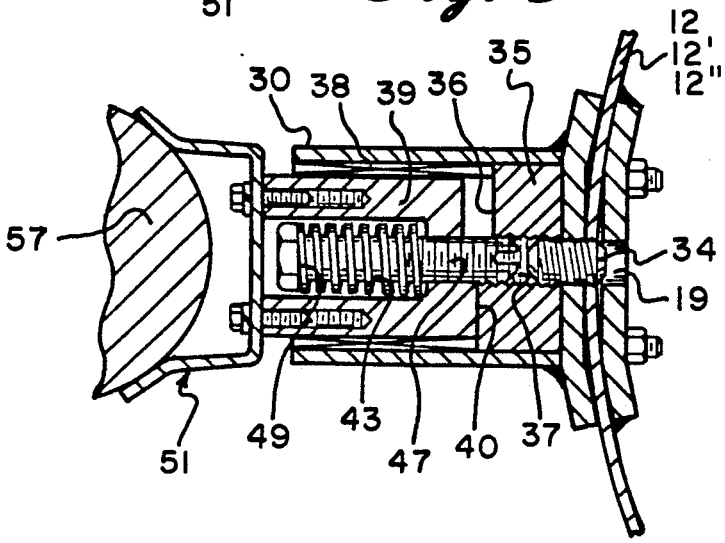
FIG. 5 is a view similar to FIG. 3 with the adjustment slot protector screw 34 in place.
Figure 4:
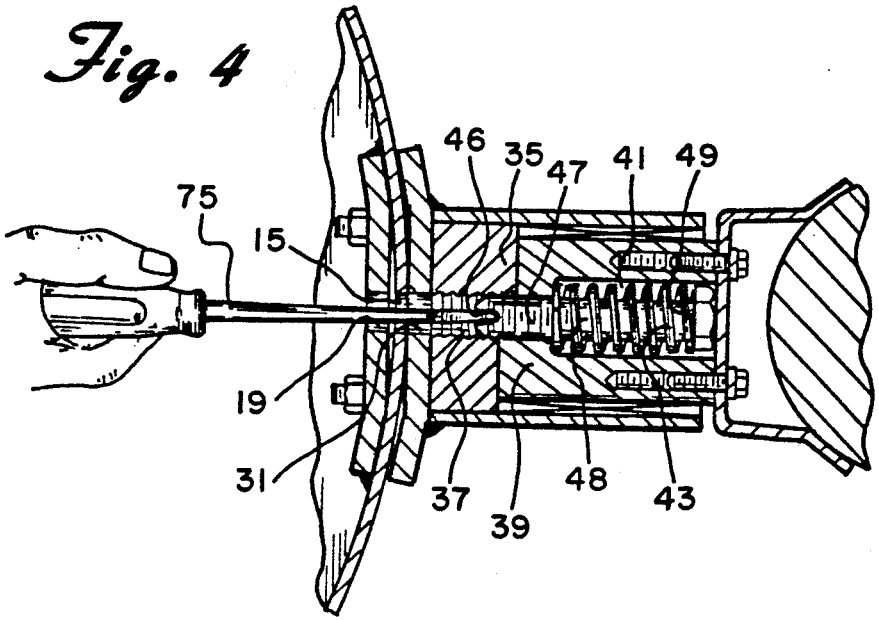
FIG. 4 is an enlarged sectional view taken along the line 4—4 in FIG. 1, showing a plan view of the use of a screwdriver or wrench to adjust the tension on the apparatus.
Figure 6:
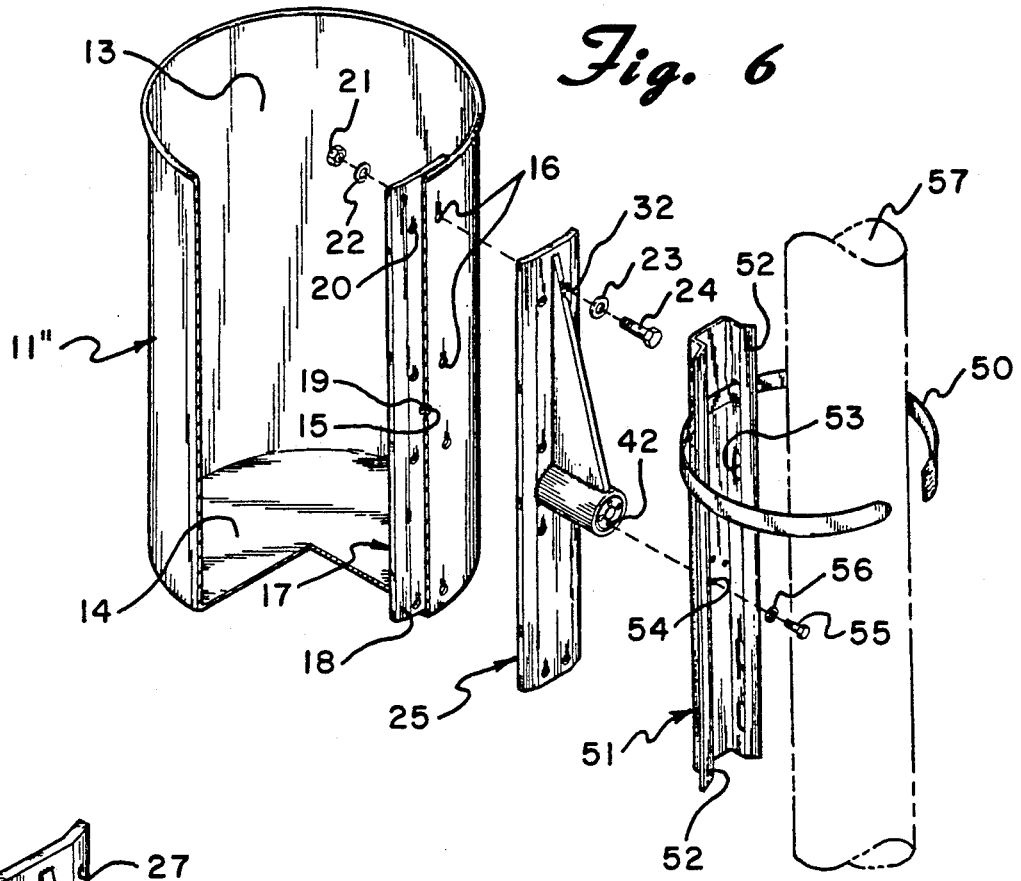
FIG. 6 is an expanded elevational view, partially in section, of an apparatus according to the invention.
Figure 7:
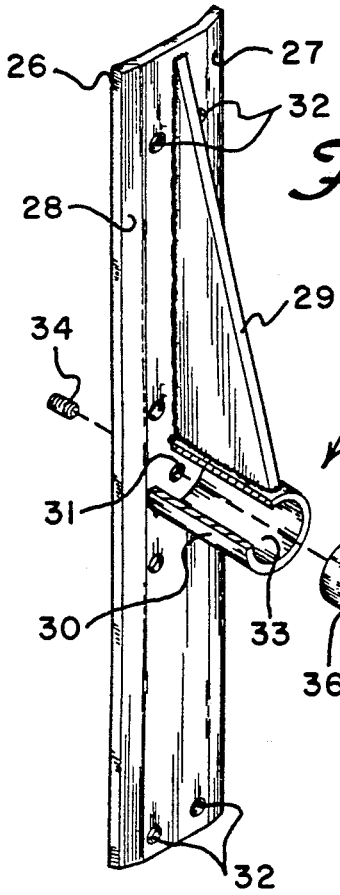
FIG. 7 is an expanded elevational view, partially in section, of the support and lock feature of one embodiment of the invention.
Figure 8:
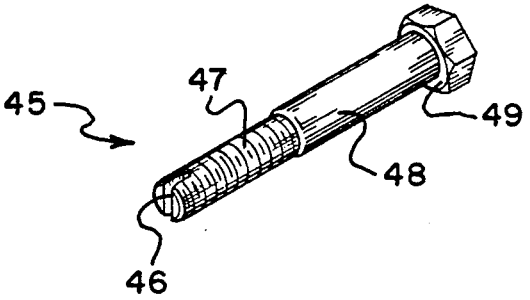
FIG. 8 is an enlarged elevational view of adjusting screw 45.

Referring again to FIG. 2, bolts 24 secure basket 12 (or 11, not shown) to rotating support bracket 26 which is reinforced by reinforcement weldment 29 and on which is also welded first cylindrical structure/bearing housing weldment 30 which is a component of integral supporting and locking means 25; second cylindrical structure 39 which has key 40 (FIGS. 3 and 5) which interlocks with reciprocal keyway 36 on rotating interlocking cylinder 35 (FIG. 7). Second cylindrical structure 39 has threaded mounting holes 42 which are secured to pole mounting bracket 51 with bolts 55 which have locking washers 56 and go through bracket mounting holes 54. Second cylindrical structure (second cylindrical structure) 39 also has an adjusting screw aperture 41 in which fits adjusting spring 43 which has space, in turn, for special adjusting screw 45 (FIG. 8) having an adjusting screw spring retainer head 49, body 48, threaded portion 47, and adjusting screw slot 46, and is of size to engage the threads in adjusting screw threaded hole 37 of rotating interlocking keyed cylinder 35 which fits within bearing 38 which, in turn, fits within bearing housing aperture 33 of first cylindrical structure/bearing housing weldment 30. Rotating support bracket 26 also has an adjusting screw access hole 31 through which a screwdriver 75 can be inserted to adjust the tension on adjusting spring 43 through a trash container adjusting screw hole 15; and right forged flange 27 and left, forged flange 28; and bracket mounting holes 32. FIGS. 3, 5, and 7 show adjustment slot protector screw 34 which is optionally used to lock adjusting screw 45 from unintended rotation and to deter unauthorized access to said adjusting screw 45. Adjusting spring 43 has a size so as to have an aperture 44 though which adjusting screw 45 can rotate freely. Trash container mounting holes 16 are aligned with integral supporting and locking means 25 and bracket weldment 17 having mounting holes 20 and forged flange 18, on the inside of trash container 11 aligned with trash container bracket mounting hole 19, through all of which trash container mounting nut 21 fits, and is secured with trash container mounting lockwasher 22, and flatwasher 23.

Figure 9:
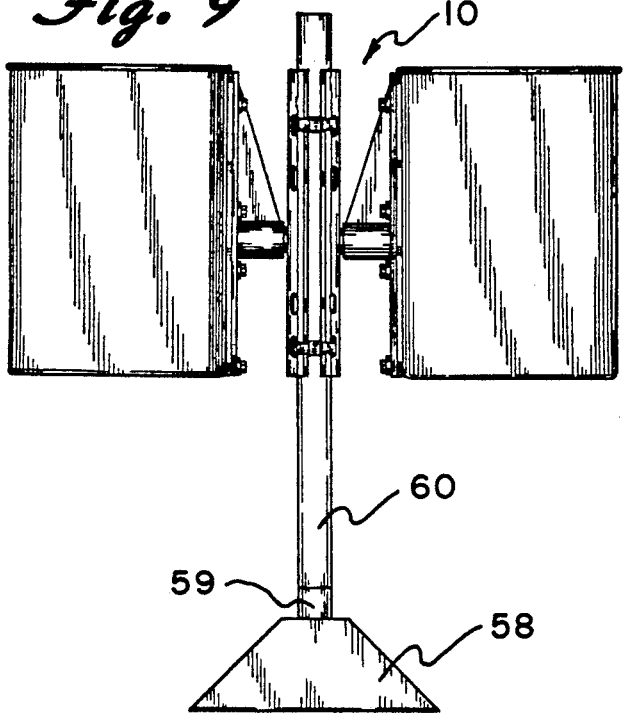
FIG. 9 is an elevational view of an apparatus according to the invention.
Figure 10:
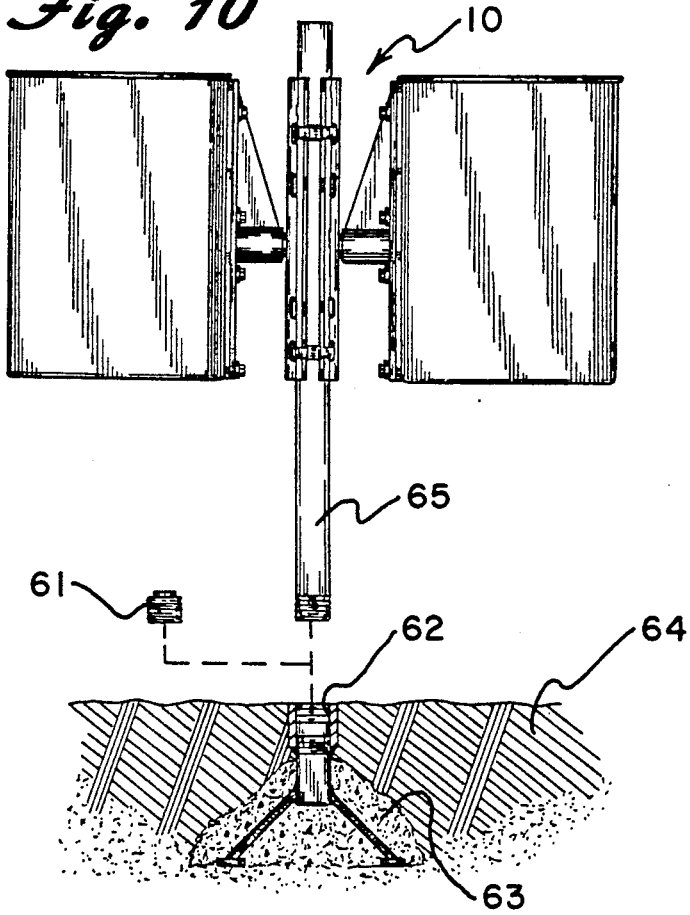
FIG. 10 is an elevational view of an apparatus according to the invention showing a support structure 63 embedded in concrete 64.
Figure 11:
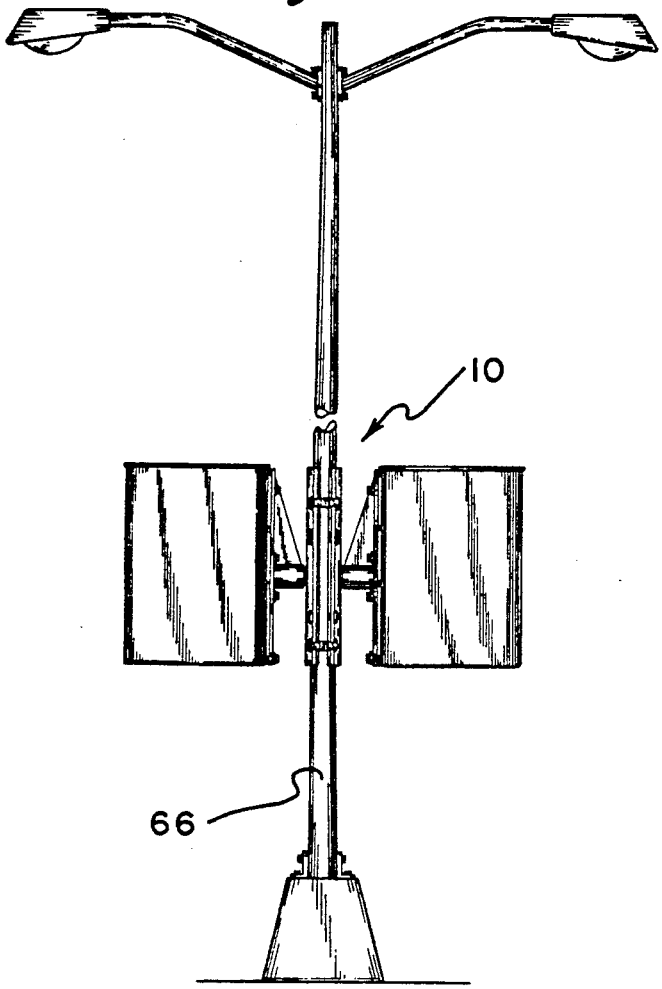
FIG. 11 is an elevational view of an alternative embodiment of the invention.

Referring to FIG. 1, pole mounting bracket 51 has two forged flanges 52 and bracket band adapters 53 for adaption to pole 57 which is shown in FIG. 9 as pole 60 mounted in a concrete base hub 59 and concrete base 58, or a metal pole 65 (FIG. 10) can be fitted with a threaded cap 61 and cemented in ground base 62. In an alternative embodiment shown in FIG. 11, the apparatus of the invention can be conveniently mounted on a street parking area light fixture 66. In embodiments where a basket is supported by a wall such as 74 in FIG. 12, nut 67, lockwasher 68, bolt 69, washer 70, are arranged to secure the apparatus to block of wood 71 which is in turn secured to wall 74 with lag bolt 72, flat washer 73, or the like.

The improved apparatus for collecting and removal of trash of the invention has all of the advantages of the apparatus described in my prior patent mentioned supra, but has the further advantage of being much simpler and faster to operate, not needing a latch and key arrangement which are subject to vandalism, require a separate operation by the person emptying the trash, as contrasted with the apparatus of the invention which merely requires pulling and turning, emptying, then returning the basket to the upright position where the basket automatically locks itself in the upright position.

While my preferred embodiments have been described with particularity herein, various alternative embodiments should become readily apparent to those skilled in the art without departing from the spirit and scope of the invention.

What is claimed as my invention is:

1. An apparatus for collecting and removal of trash comprising at least one basket, integral supporting and locking means for connecting said basket to a supporting structure, said means adapted to (A) support said basket, (B) lock said basket in a normal upright position for receiving and holding trash, (C) be unlocked so as to permit rotation of said basket for emptying said trash wherein said means to lock against rotation includes a stationary interlocking keyed cylinder, a rotating interlocking keyed cylinder, either of said stationary interlocking keyed cylinder or said rotating interlocking keyed cylinder having a key and the other having a keyway which interlock when said basket is in said normal upright position for receiving trash, and to allow said basket to be pulled to unlock said permit rotation so as to empty said trash wherein said means to lock against rotation includes a spring which is adapted to normally apply force against one of said interlocking keyed cylinders so as to maintain said key and said keyway in an interlocking position and thereby prevent rotation;

wherein said means to lock against rotation further includes a threaded adjustment screw and a complimentary threaded slot, said screw positioned so as to permit adjusting said force exerted by said spring on said interlocking keyed cylinders so as to thereby adjust the pushing or pulling force required to be exerted on said basket to unlock it for rotation;

wherein said means to lock against rotation includes a retainer head on the end of said threaded adjustment screw and a female slot in the opposite end of said threaded adjustment screw, and wherein said basket and said means to lock against rotation have an opening adapted to permit rotation of said screw by a tool from a position within said basket in a direction toward said supporting structure so as to adjust said force exerted by said spring on said interlocking keyed cylinders; and wherein means to lock against rotation further includes means to prevent access to said threaded adjustment screw.

2. Apparatus according to claim 1 wherein said integral supporting and locking means comprises a first cylindrical structure attached to the outside of said basket, a second cylindrical structure adapted to be attached to said supporting structure, one of said cylindrical structures being smaller than the other so as to fit within said other and to permit rotation around an axis through the center of said first and second cylinders, said axis being perpendicular to said supporting structure and perpendicular to said outside of said basket.

3. Apparatus according to claim 2 wherein said means to lock against rotation is normally locked and is unlocked by pulling said basket in a direction along said axis of rotation.

4. Apparatus according to claim 1 wherein said means to prevent access comprises a locking screw.

* * * * *